United States Patent [19]

Leech

[11] Patent Number: 4,535,800

[45] Date of Patent: Aug. 20, 1985

[54] VALVE SYSTEM FOR VACUUM SEWAGE COLLECTION SYSTEM

[76] Inventor: Edward H. Leech, 721 Edgar Dr., Salisbury, Md. 21801

[21] Appl. No.: 594,038

[22] Filed: Mar. 27, 1984

[51] Int. Cl.[3] ..... E03F 1/00; F16K 31/18; F16K 33/00

[52] U.S. Cl. ..... 137/205; 137/433; 137/192; 137/399; 137/513.5; 210/117; 210/121; 210/123

[58] Field of Search ..... 137/399, 427, 430, 433, 137/205, 513.5, 192; 210/100, 117, 118, 121, 123

[56] References Cited

U.S. PATENT DOCUMENTS

| | | | |
|---|---|---|---|
| 369,003 | 8/1887 | Harvey | 137/433 |
| 643,074 | 2/1900 | Sweeney | 137/399 |
| 672,384 | 4/1901 | Marvin | 137/513.5 |
| 763,115 | 6/1904 | Robinson | 137/399 |
| 922,142 | 5/1909 | Hogg | 137/399 |
| 1,140,666 | 5/1915 | Cummings | 137/399 |
| 1,732,222 | 10/1929 | Cantrall | 137/428 |
| 1,897,492 | 2/1933 | Ledoux | 137/433 |
| 2,211,296 | 8/1940 | Shaft | 137/399 |
| 2,339,922 | 1/1944 | Gatewood | 137/558 |
| 2,582,853 | 1/1952 | Smith | 137/403 |
| 2,756,769 | 7/1956 | Martin | 137/416 |
| 3,224,460 | 12/1965 | Cann | 137/399 |
| 4,030,520 | 6/1977 | Sands | 137/513.5 |
| 4,243,066 | 1/1981 | Lambie | 137/430 |
| 4,333,830 | 6/1982 | Michael | 137/205 |

FOREIGN PATENT DOCUMENTS

| | | | |
|---|---|---|---|
| 1293651 | 10/1972 | United Kingdom | 137/399 |

*Primary Examiner*—Ernest G. Therkorn
*Attorney, Agent, or Firm*—John F. McClellan, Sr.

[57] ABSTRACT

A system for automatic evacuation of sewage from a holding tank or tanks in a vacuum operated sewage system provides in preferred embodiment a spherical holding tank with laterally located port for sewage intake, bottom port for sewage discharge to a vacuum main and detachably-covered top port for installation, inspection and maintenance. A float covers the bottom port until sufficient sewage collects to buoy it up, uncovering the bottom port and permitting vacuum discharge of the sewage in the holding tank. Ballast orients the float at all times. Rings of grooves in the lower exterior of the float insure sufficient leakage past the float to maintain portage in the vacuum discharge line. Simple ballast adjustment is provided.

1 Claim, 6 Drawing Figures

FIG. 2A
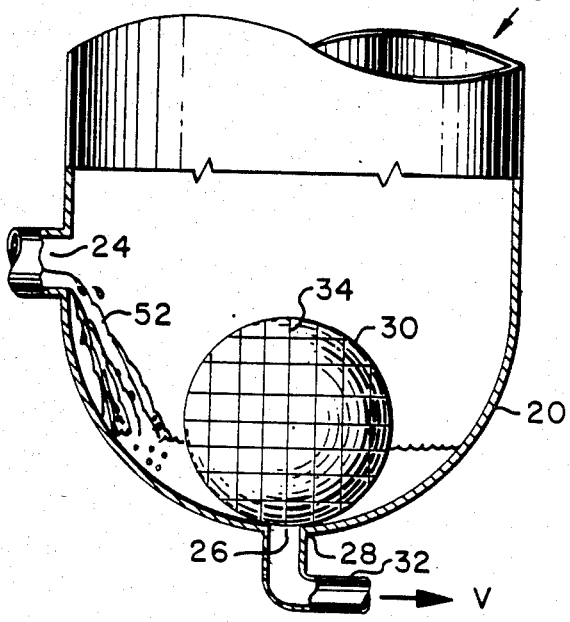
FIG. 2B
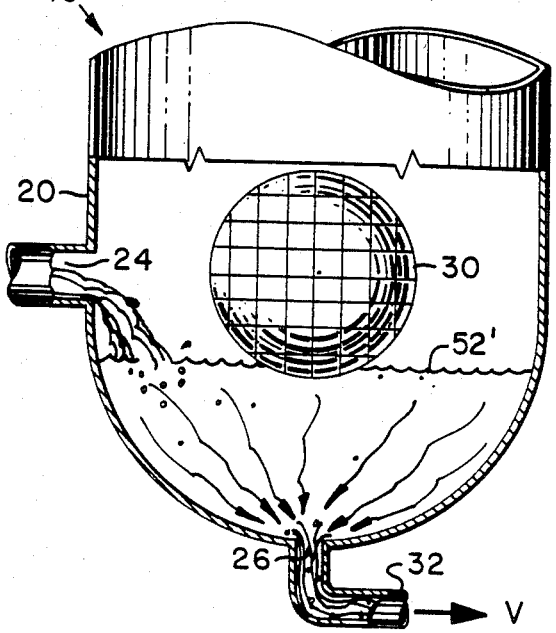
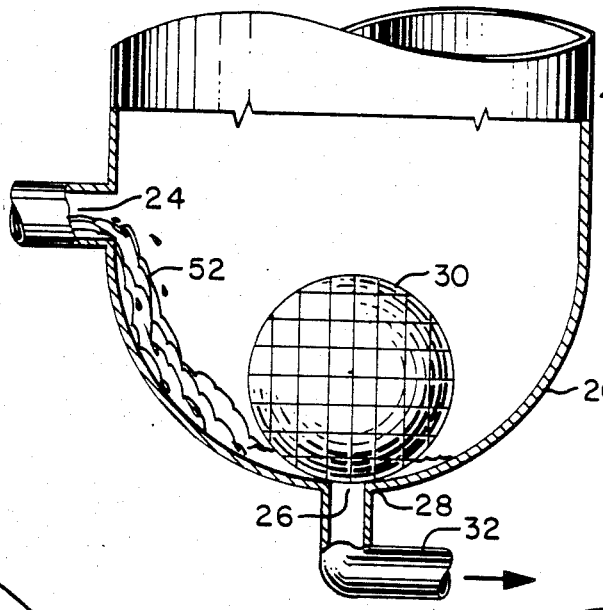
FIG. 2C
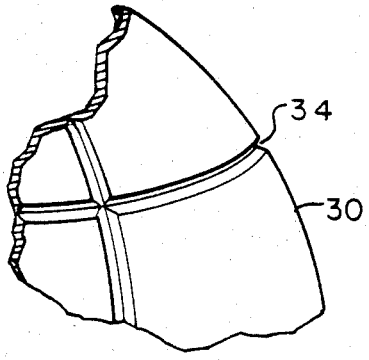
FIG. 3
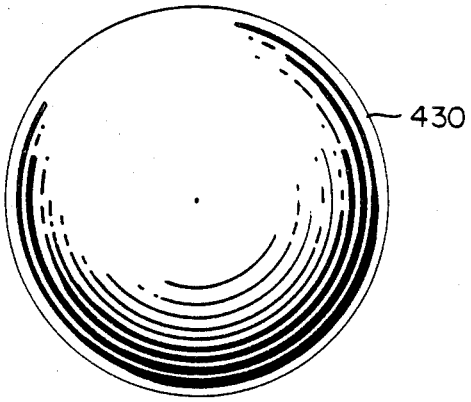
FIG. 4

VALVE SYSTEM FOR VACUUM SEWAGE COLLECTION SYSTEM

FIELD OF THE INVENTION

This invention relates generally to vacuum-type collection systems for sewage and particularly to an improved valve system for use therewith.

SUMMARY OF THE INVENTION

Vacuum operated sewage systems provide known advantages, such as lower initial construction costs. Lines can follow topography and such systems provide an economically viable system to separate sanitary sewage from combined storm and sanitary sewers. However, no system available is believed to be entirely satisfactory.

A principal object of the invention is to provide a new and substantially improved valve system for use in holding tanks in vacuum operated sewage collection systems.

Further objects are to provide a system as described that operated automatically and reliably, and that can be remotely controlled for scouring, reducing peak loads and similar purposes without special connections or apparatus for same, including selective control of different units by volume of sewage at unit.

Still further objects are to provide a valve system as described that is simple and economical to make, install, adjust and operate with lower operational and maintenance costs. "Open tank" problems associated with present valve systems would be essentially eliminated as result of the mechanical simplicity of this system.

Yet further objects are to provide a valve system as described that is compatible with present on-line systems, that can maintain portage in locations where maintenance of portage is a problem, that is less susceptible to clogging and freezing, that can suppress septic problems by frequent automatic and dynamic emptying of holding tanks.

BRIEF DESCRIPTION OF THE DRAWINGS

The above and other objects and advantages of this invention will become more readily apparent on examination of the following description, including the drawings in which like reference numerals refer to like parts.

Figure 1:
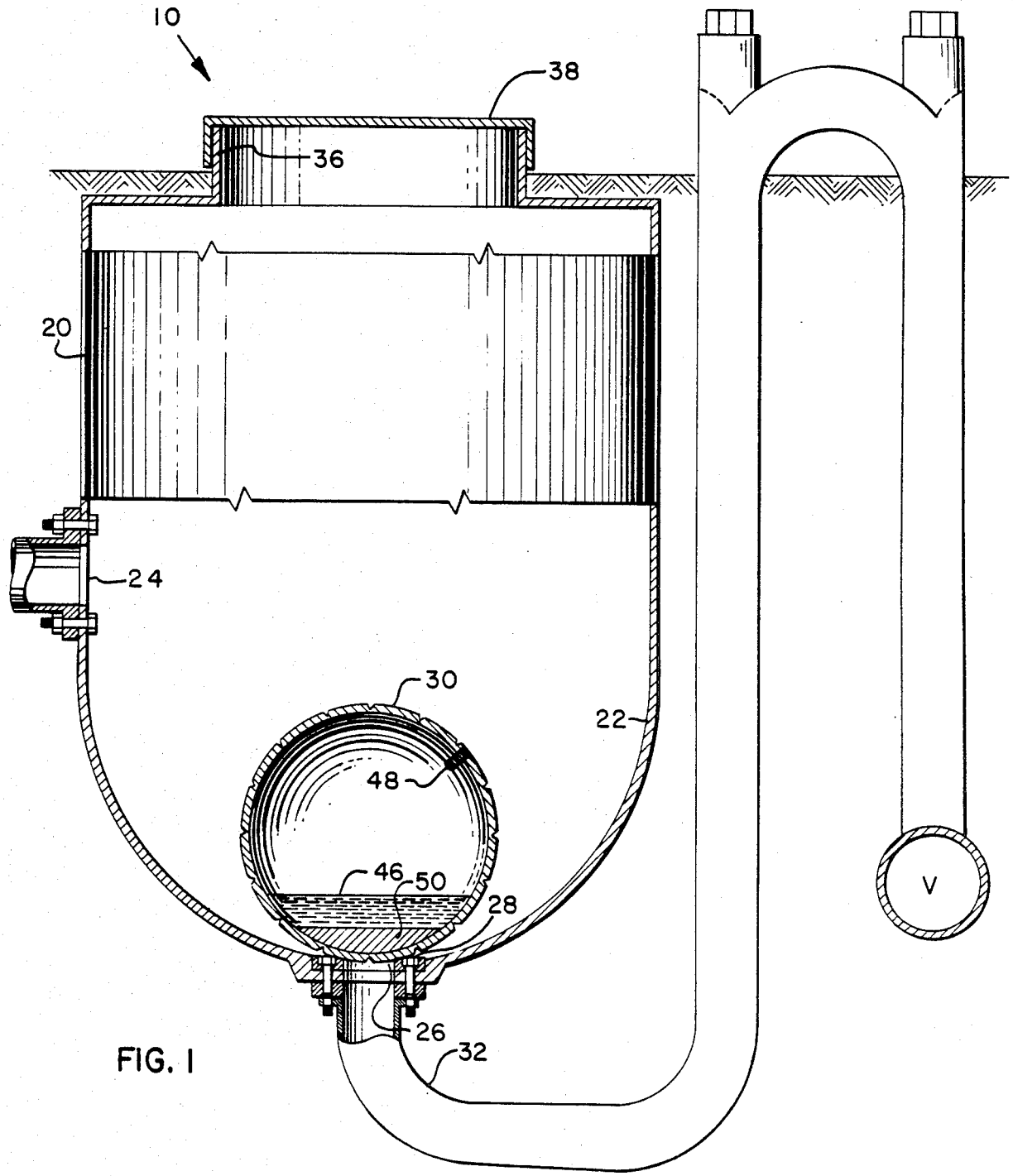
FIG. 1 is an elevational view, partly in section showing a preferred embodiment of the tank valve system installed as part of a sewage system.

FIGS. *2a, 2b* and *2c* are similar elevational view diagrams, partly in section, diagramming successive cyclical positions, in automatic operation;

FIG. 3 is a detail better showing preferred structure of the spherical component indicated in the above Figures; and FIG. 4 shows an alternative detail for the spherical component.

DETAILED DESCRIPTION

FIGS. 1 and *2a, 2b* and *2c* show the invention in preferred embodiment 10 as part of a vacuum system for sanitary sewage collection. Holding tank 20 may be hemispherical at the lower end as shown or may be of other suitable design, smoothly faired into the tank overall shape. The tank should have three ports or openings in the wall 22:

(1) Lateral opening or sewage intake opening 24 may be located up about one-third to one-half the distance from the bottom of the holding tank, and receives sewage from the chosen source, domestic or industrial; more than one intake may be used with a holding tank.

(2) Bottom opening or sewage discharge opening 26 is located symmetrically about the vertical axis of the spherical shape and is closable at flange seat 28 by a spherical float 30 against suction in discharge line 32 from a vacuum main. The generally rounded shape of the holding tank bottom is a means for causing the float to center gravitationally on the discharge port. Grooves or leakage-producing contours extending around the float aid portage in the vacuum line and help eliminate septic problems as will be explained. Preferably the float has a plurality of these over the surface.

(3) Top opening or access opening or port 36 is preferably located axially above the bottom opening and is closable by a cover 38. Through this opening assembly and maintenance access is provided.

Liquid ballast 46 may be added or subtracted to adjust buoyancy through tap 48, which may be a threaded hole with removable screw. Permanent poured lead or other ballast 50 may be provided to set buoyance or to keep the float oriented the same way, as an optional provision.

OPERATION

FIG. *2a* diagrams the invention with the valve closed and sewage 52 flowing in before reaching a level sufficient to buoy up the float 30. Grooves 34 on float 30 allow small amounts of air leakage to assist portage of sewage in the vacuum collection system and to help prevent septic conditions at the tank, which might otherwise occur.

The float 30 is normally held on the flange or seat by pump-vacuum V in the sewage system downstream, aided by weight and ballast of the float.

When sufficient sewage flows into the tank or when the differential force caused by the vacuum is lessened, the float will rise to the top of the sewage and allow the vacuum to evacuate the tank. The float is thus a means for controlling the discharge of sewage through the discharge port, against which it fits.

FIG. *2b* diagrams the buoyant rising of the float 30, that automatically causes evacuation of the accumulated sewage from the holding tank 20 when sewage has accumulated to the dump level 52'.

FIG. *2c* diagrams the gravity re-set position of the float 30, again in position to accumulate another charge of sewage.

FIG. 3 details on a larger scale and as a fragment, a form and proportion of suitable rings of grooves 34 on float 30.

ALTERNATIVE EMBODIMENT

FIG. 4 shows a detail of an alternative embodiment float 430 otherwise similar to the float of the first embodiment but without the grooves in the float.

CONSTRUCTION DETAILS

Construction throughout is by conventional manufacturing techniques. The float can have other configurations than that preferred, so long as the bottom portion has a generally circular-section shape at the discharge port. Preferably, the holding tank should be similar to that shown. The float should have a displacement of ten gallons or more. The volume of the holding tank should be at least five times the volume of the float, but can be much larger to allow for system "downtime".

The intake line may be, as an example, four-inch pipe; the discharge line may have a 2 inch or 3 inch flange and sweep depending on design sewage volume.

The top opening should be large enough to pass the float freely for installation and removal.

Material for holding tank and/or float can be steel or fibreglass resin or other suitable materials compatible with sanitary sewage systems.

It will be appreciated that holding tanks according to this invention can be easily "scoured" by reducing the vacuum-caused differential force at the vacuum source for a short period, permitting floats to rise in tanks where operating levels have not been reached. This action should eliminate many septic problems and thus odor problems.

Tanks may also be evacuated selectively based on the amount of sewage in the tanks by varying the vacuum in the system. That is, by lowering the vacuum, the fuller tanks can be evacuated first. This system is compatible with present on-line systems but for optimum effectiveness "old" systems should be replaced as soon as economically feasible.

The system of this invention could also be used as a metering valve system in other applications.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a vacuum-type sewage collection system having a holding tank with top and bottom and at least one intake port, a discharge port and discharge line connected with a vacuum main, and means for controlling discharge of sewage through said discharge port, the improvement comprising: the discharge port being at the bottom of the holding tank, the means for controlling comprising a float with a part thereof proportioned for fitting against said discharge port, said float porportion including a generally rounded lower portion, means for orienting said float, said orienting means being permanent ballast in said float generally rounded lower portion; means for adjusting buoyancy of said float, including means for holding liquid within said float; said generally rounded lower portion being part of a spherical overall shape of the float, means for causing the float to center gravitationally on the discharge port including the holding tank bottom having a generally rounded shape; the generally rounded shape of the holding tank bottom being faired into the overall shape of the holding tank, means for preserving sewage portage in said discharge line comprising a plurality of leakage-producing contours at said part of the float proportioned for fitting against said discharge port, said holding tank having an access port therein above the discharge port, and a cover for said access port, and the access port being large enough for removal of the float therethrough.

* * * * *